US008870417B2

(12) United States Patent
Pickard et al.

(10) Patent No.: US 8,870,417 B2
(45) Date of Patent: Oct. 28, 2014

(54) SEMI-INDIRECT AISLE LIGHTING FIXTURE

(75) Inventors: Paul Kenneth Pickard, Morrisville, NC (US); Elizabeth Ann Rodgers, Raleigh, NC (US)

(73) Assignee: Cree, Inc., Durham, NC (US)

( * ) Notice: Subject to any disclaimer, the term of this patent is extended or adjusted under 35 U.S.C. 154(b) by 295 days.

(21) Appl. No.: 13/365,180

(22) Filed: Feb. 2, 2012

(65) Prior Publication Data

US 2013/0201674 A1 Aug. 8, 2013

(51) Int. Cl.
*F21V 29/00* (2006.01)

(52) U.S. Cl.
USPC ..... 362/373; 362/249.02

(58) Field of Classification Search
CPC ..... F21Y 2101/02; F21Y 2103/003; F21Y 29/004; F21Y 29/2262
USPC ..... 362/249.02, 373, 249.01, 218
See application file for complete search history.

(56) References Cited

U.S. PATENT DOCUMENTS

| | | | | |
|---|---|---|---|---|
| 5,823,663 | A | 10/1998 | Bell et al. | 362/362 |
| 6,210,025 | B1 | 4/2001 | Schmidt et al. | 362/362 |
| 7,049,761 | B2 | 5/2006 | Timmermans et al. | 315/246 |
| 7,213,940 | B1 | 5/2007 | Van de Ven et al. | 362/231 |
| 7,510,299 | B2 | 3/2009 | Timmermans et al. | 362/225 |
| 7,712,918 | B2 | 5/2010 | Siemiet et al. | 362/241 |
| 7,722,220 | B2 | 5/2010 | Van de Ven | 362/294 |
| 7,768,192 | B2 | 8/2010 | Van de Ven et al. | 313/503 |
| 7,815,338 | B2 | 10/2010 | Siemiet et al. | 362/218 |
| 7,887,216 | B2 | 2/2011 | Patrick et al. | |
| 8,092,049 | B2 | 1/2012 | Kinnune et al. | 362/294 |
| 2004/0001344 | A1 | 1/2004 | Hecht | |
| 2007/0115670 | A1 | 5/2007 | Roberts et al. | |
| 2007/0115671 | A1 | 5/2007 | Roberts et al. | |
| 2009/0225543 | A1 | 9/2009 | Roberts et al. | |
| 2009/0323334 | A1 | 12/2009 | Roberts et al. | |

(Continued)

FOREIGN PATENT DOCUMENTS

| | | | |
|---|---|---|---|
| EP | 1298383 | A2 | 4/2003 |
| EP | 1847762 | A2 | 10/2007 |

(Continued)

OTHER PUBLICATIONS

Office Action from Japanese Design Patent Application No. 2011-18570.

(Continued)

*Primary Examiner* — Vip Patel
(74) *Attorney, Agent, or Firm* — Koppel, Patrick, Heybl & Philpott

(57) ABSTRACT

A modular lighting fixture assembly. Multiple light pods can be removably mounted on both lateral sides of a mechanical thermal element, such as an elongated heat sink. The pods can be easily removed for cleaning, maintenance, and transport, for example. A light strip including multiple LEDs can be mounted to a surface of the heat sink on both sides. Each pod has a portion cutaway such that when the pods are mounted to the heat sink, the cutaway portions align with the light strips. Thus, when mounted, the light strip can be adjacent to or protrude into an interior cavity of the pod. The interior surfaces of the pods are shaped to redirect light in a particular output profile. The assembly may be mounted to a ceiling and used as an overhead fixture designed to efficiently light an aisle in a retail space or a storage facility, for example.

36 Claims, 10 Drawing Sheets

(56) References Cited

U.S. PATENT DOCUMENTS

| | | | | |
|---|---|---|---|---|
| 2011/0199005 | A1 | 8/2011 | Bretschneider et al. | |
| 2011/0199769 | A1 | 8/2011 | Bretschneider et al. | |
| 2012/0147603 | A1 * | 6/2012 | Hochstein | 362/247 |

FOREIGN PATENT DOCUMENTS

| | | | |
|---|---|---|---|
| JP | 2011018571 | | 8/2011 |
| JP | 2011018572 | | 8/2011 |
| WO | WO 2011140353 | A2 | 11/2011 |

OTHER PUBLICATIONS

Reason for Rejection from Japanese Design Patent Application No. 2011-18571.

Reason for Rejection from Japanese Design Patent Application No. 2011-18572.

U.S. Appl. No. 12/873,303, filed Aug. 31, 2010, to Edmond, et al.

U.S. Appl. No 12/961,385, filed Dec. 6, 2010, to Pickard, et al.

International Search Report and Written Opinion for Patent Application No. PCT/US2011/001517. dated: Feb. 27. 2012.

* cited by examiner

FIG. 1
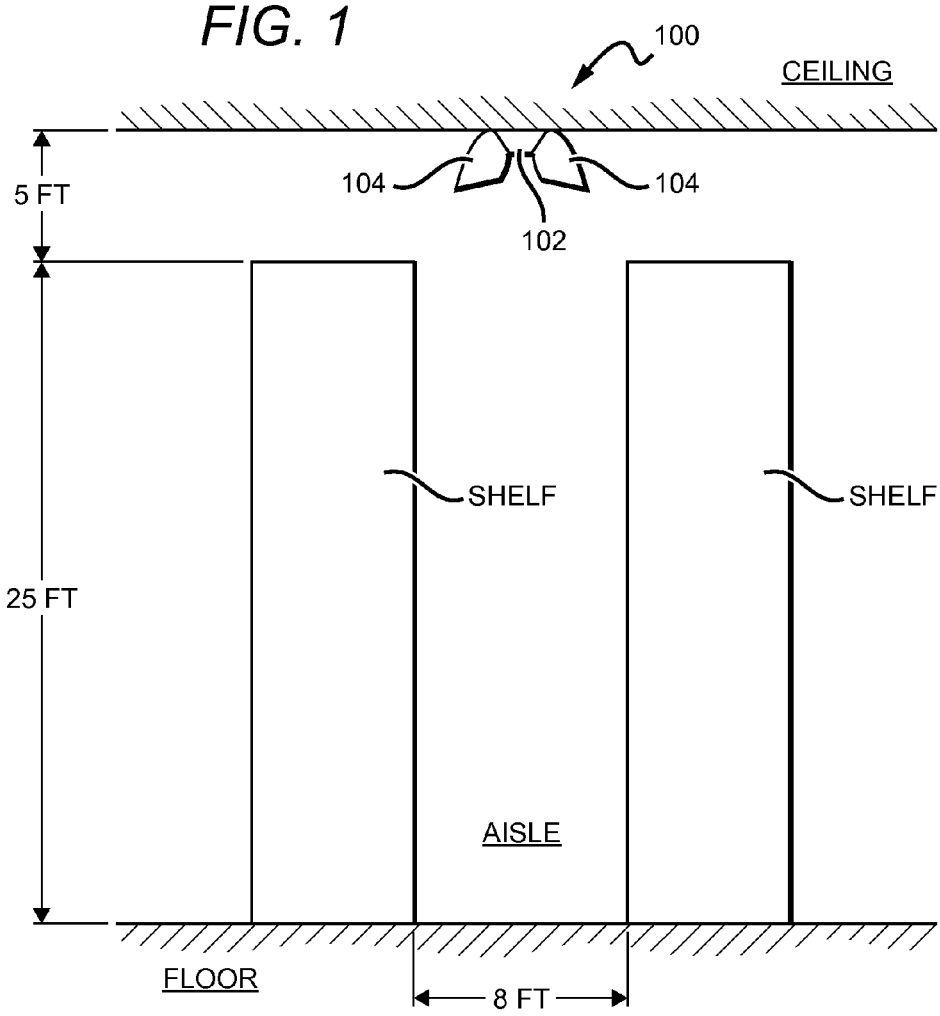
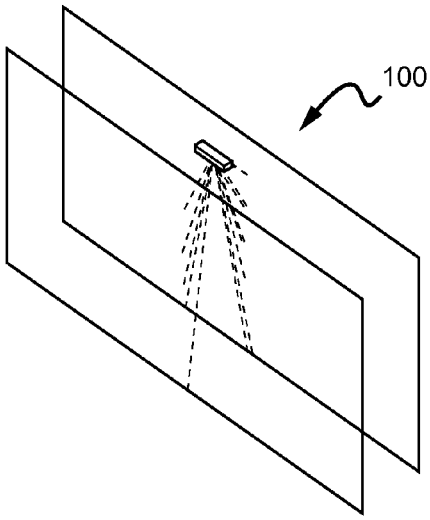
FIG. 2

FIG. 6a
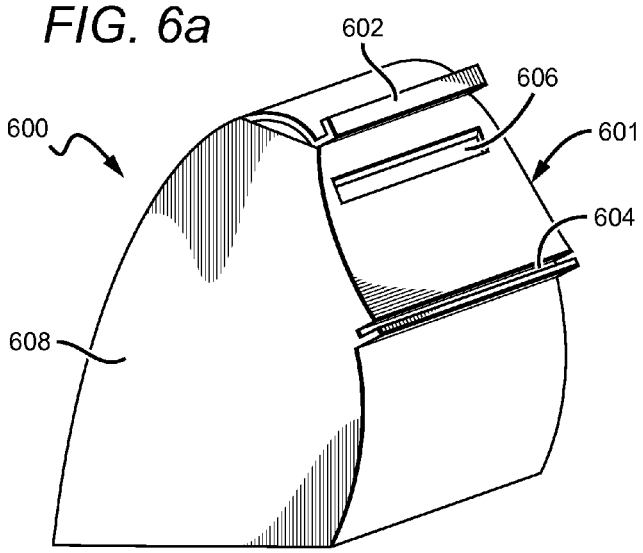
FIG. 6b
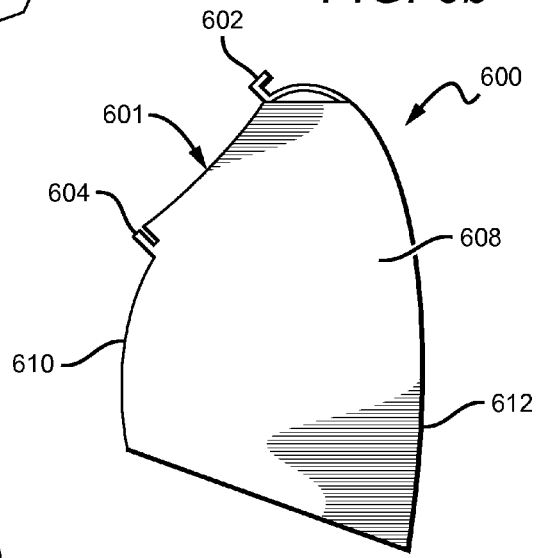
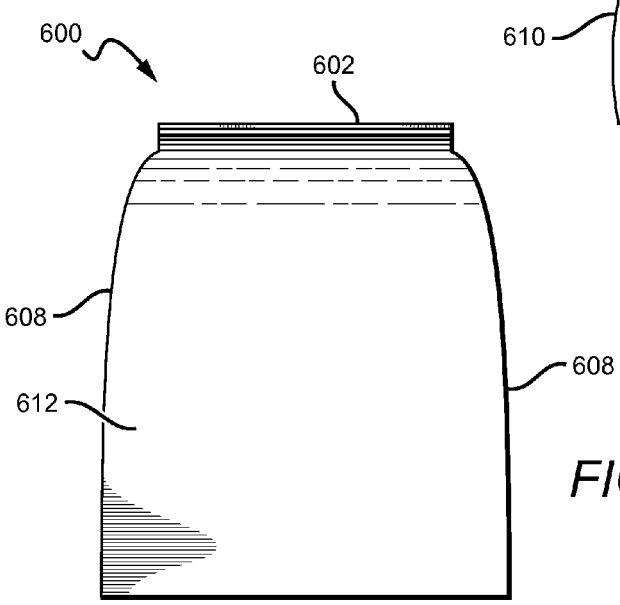
FIG. 6c

FIG. 9b
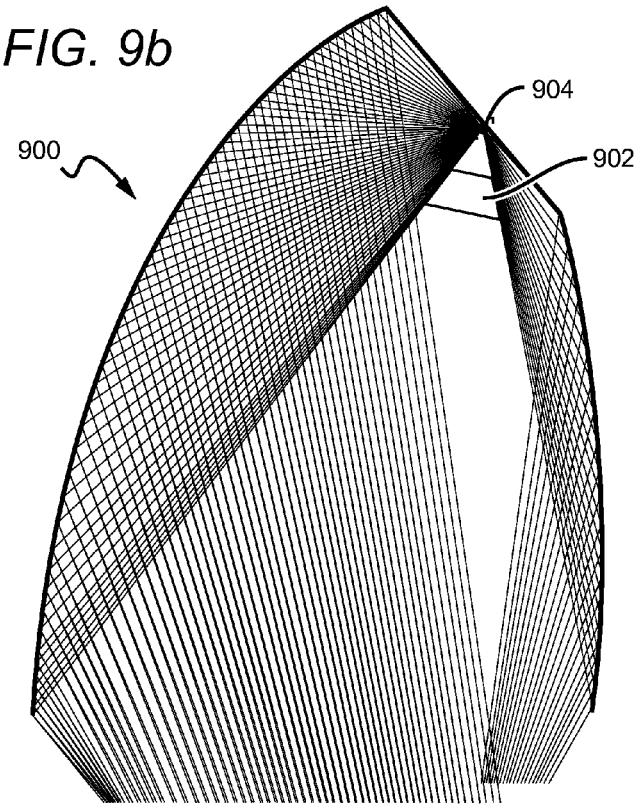
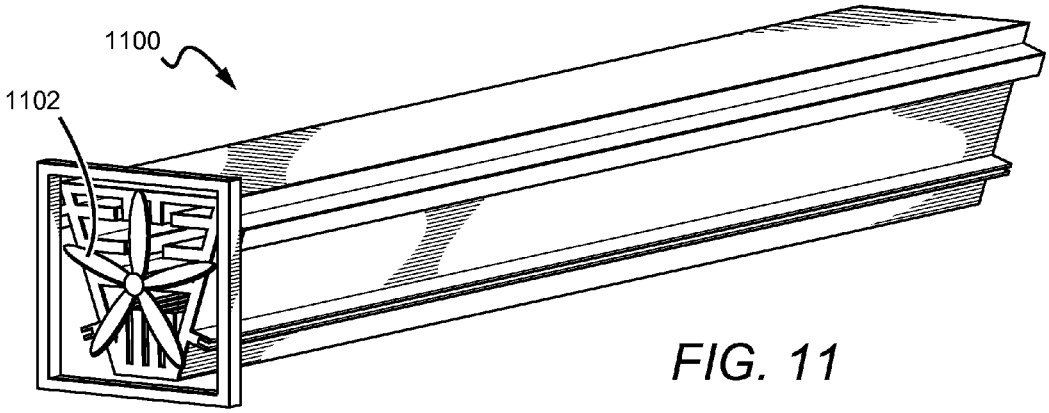
FIG. 11

SEMI-INDIRECT AISLE LIGHTING FIXTURE

BACKGROUND OF THE INVENTION

1. Field of the Invention

The invention relates to lighting fixtures and, more particularly, to semi-indirect lighting fixtures that are well-suited for use with solid state lighting sources, such as light emitting diodes (LEDs).

2. Description of the Related Art

Light emitting diodes (LEDs) are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs, by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a printed circuit board (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "down-converts" some of the blue light, changing it to yellow light. Some of the blue light passes through the phosphor without being changed while a substantial portion of the light is down-converted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Typical direct view lamps, which are known in the art, emit both uncontrolled and controlled light. Uncontrolled light is light that is directly emitted from the lamp without any reflective bounces to guide it. According to probability, a portion of the uncontrolled light is emitted in a direction that is useful for a given application. Controlled light is directed in a certain direction with reflective or refractive surfaces. The mixture of uncontrolled and controlled light defines the output beam profile.

Also known in the art, a retroreflective lamp arrangement, such as a vehicle headlamp, utilizes multiple reflective surfaces to control all of the emitted light. That is, light from the source either bounces off an outer reflector (single bounce) or it bounces off a retroreflector and then off of an outer reflector (double bounce). Either way the light is redirected before emission and, thus, controlled. In a typical headlamp application, the source is an omni-emitter, suspended at the focal point of an outer reflector. A retroreflector is used to reflect the light from the front hemisphere of the source back through the envelope of the source, changing the source to a single hemisphere emitter.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

SUMMARY OF THE INVENTION

One embodiment is a light fixture assembly that comprises an elongated heat sink with at least one light pod removably mounted to at least one surface of the heat sink. Each of the light pods comprises a hollow body. The hollow body defines an interior cavity and an open end.

Another embodiment is a light pod comprising the following elements. A base defines a cutaway portion shaped to receive an external light source. The base comprises a mount structure for removably mounting the light pod to an external structure. A first reflective interior surface extends from the base. The first reflective interior surface is shaped to redirect incident light in a direction away from the base. A second reflective interior surface is opposite the first reflective interior surface and extends from the base. The second reflective interior surface is curved to redirect incident light in a direction away from the base. First and second reflective interior side panels extend from the base and between the first and second surfaces. In the base, the first and second reflective interior surfaces, and the first and second side panels define an interior cavity and an open end.

An embodiment of a lighting assembly comprises the following elements. At least one light strip comprising at least one light source is mounted to a surface of an elongated heat sink. At least one light pod is removably mounted to the heat sink, each of the light pods comprising a body that defines a cutaway portion, an interior cavity, and an open end. The at least one light pod is mounted to the heat sink such that the light strip is aligned with the cutaway portion of the light pod.

Another embodiment of a light fixture assembly comprises the following elements. At least one light pod is removably mounted to at least one surface of a mechanical thermal element, each of the light pods comprising a hollow body that defines an interior cavity and an open end.

BRIEF DESCRIPTION OF THE DRAWINGS

FIG. 1 is a side view of a lighting assembly according to an embodiment of the present invention.

FIG. 2 shows a schematic representation of the light assembly according to an embodiment of the present invention from an angle above the ceiling.

FIGS. 6*a-d* show a light pod that may be used in lighting assemblies according to embodiments of the present invention.

FIGS. 9*a* and 9*b* are cross-sectional views of the interior surfaces of a light pod according to an embodiment of the present invention wherein the paths of several light rays are modeled.

FIG. 11 is a perspective view of a heat sink that may be used in lighting assemblies according to embodiments of the present invention.

DETAILED DESCRIPTION OF THE INVENTION

Figure 3:
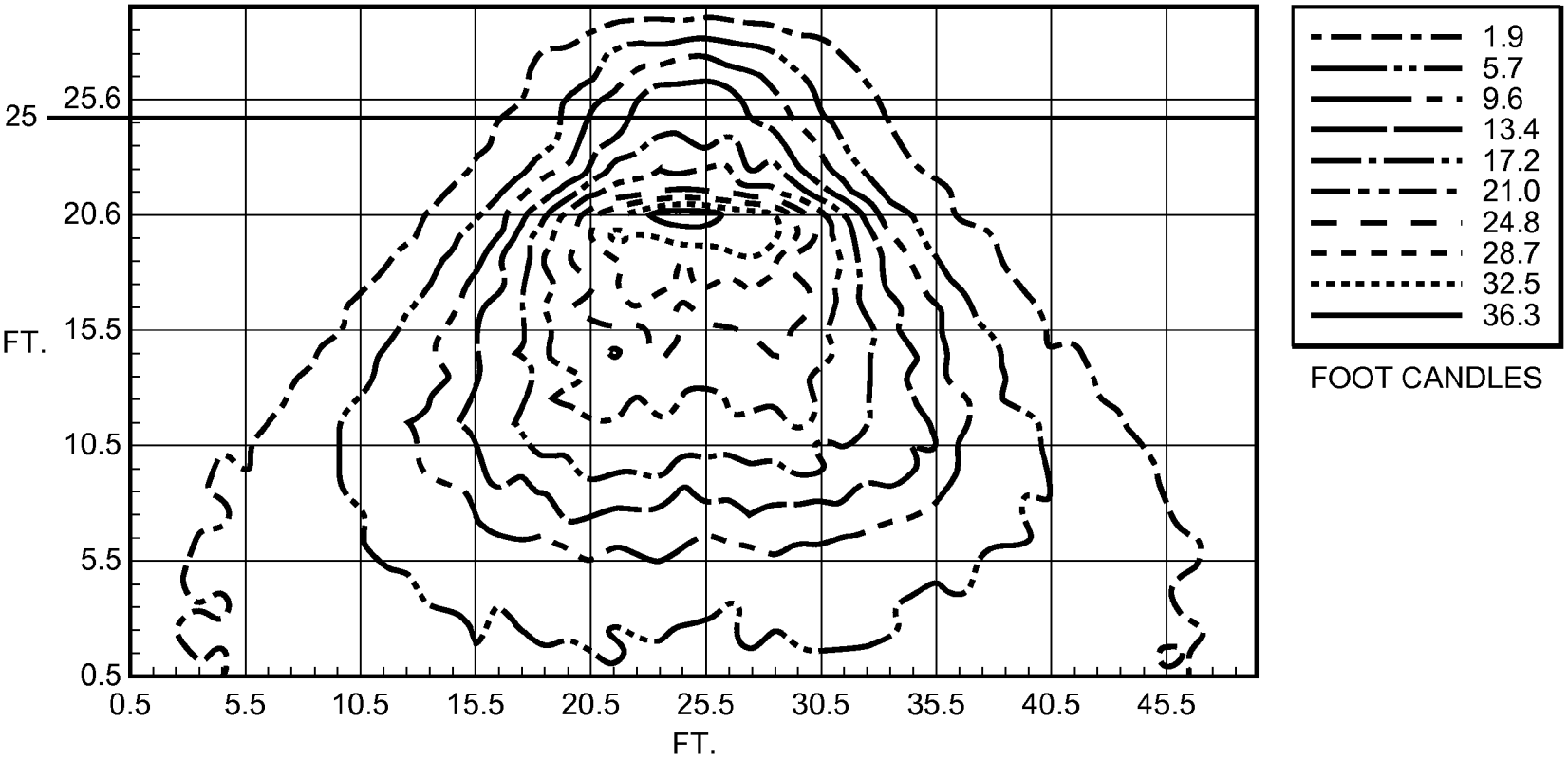
FIG. 3 is a graph showing a model of the light intensity over a two-dimensional area on a shelf from an embodiment of a lighting assembly according to the present invention.

Embodiments of the present invention provide a modular lighting fixture assembly that is well-suited for use with LEDs. A mechanical thermal element, such as an elongated heat sink, provides a central structure to which multiple light pods can be removably mounted. The pods can be mounted on both lateral sides of the heat sink, so that the pods can be easily removed for cleaning, maintenance, and transport, for example. A light strip including multiple LEDs can be mounted to a surface of the heat sink on both sides. Each of the pods has a portion cutaway such that when the pods are mounted to the heat sink, the cutaway portions align with the light strips. Thus, when mounted, the light strips can be adjacent to or protrude into an interior cavity of the pods. The interior surfaces of the pods are shaped to redirect light in a particular output profile. In one embodiment, the assembly may be mounted to a ceiling and used as an overhead fixture designed to efficiently light an aisle in a retail space or a storage facility, for example.

Embodiments of the present invention are described herein with reference to conversion materials, wavelength conversion materials, remote phosphors, phosphors, phosphor layers and related terms. The use of these terms should not be construed as limiting. It is understood that the use of the term remote phosphors, phosphor or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of layers can be different, and variations from the shapes of the illustrations as a result, for example, of manufacturing techniques and/or tolerances are expected. Thus, the regions illustrated in the figures are schematic in nature and their shapes are not intended to illustrate the precise shape of a region of a device and are not intended to limit the scope of the invention.

FIG. 1 is a side view of a lighting assembly 100 according to an embodiment of the present invention. As shown, the lighting assembly 100 is mounted to a ceiling over an aisle in between two shelves. Embodiments of the lighting assembly 100 are particularly useful for lighting such an environment. The lighting assembly 100 comprises a mechanical thermal element in the form of an elongated heat sink 102 and light pods 104 mounted on both sides. In this view, only the two light pods 104 on the end of the assembly 100 are shown. However, additional light pods can be disposed adjacent to those shown along the length of the heat sink 102.

In the environment shown, the light assembly 100 is surface mounted to the ceiling at a height of 30 ft. The shelves extend up 25 ft from the floor on either side of the aisle which is 8 ft wide. Thus, in this embodiment, the light assembly 100 is designed to produce a beam profile wherein substantially all of the light is projected along the entire height of both shelves and into the aisle. It is understood that the light assembly 100 may be designed for many different mount heights and various orientations.

FIG. 2 shows a schematic representation of the light assembly 100 from an angle above the ceiling. In this view, light rays lying within a plane bisecting the assembly 100 and perpendicular to the shelves are shown emanating from the assembly 100, illuminating the shelves along their entire height. The output profile of the beam coming from each pod is determined by the beam-shaping properties of the pod itself (e.g., the shape of the interior surfaces and any lenses included therein).

FIG. 3 is a graph showing the intensity of the light in a two-dimensional area on one of the shelves when an embodiment of the assembly 100 is modeled using Photopia, a common photometric analysis CAD suite. The isobars represent areas on the shelf of uniform illuminance (in foot-candles). As shown, the light is distributed over the entire height of the shelf, with very little of the light being distributed into the area above the shelf (i.e., above 25 ft). As expected, the light spreads out across the length of the shelf as the distance from the fixture increases. In one embodiment, adjacent pods and assemblies will create an overlapping light pattern that efficiently lights both the shelves and the aisle while confining the light in a longitudinal direction so that consumers/employees can easily see items on the shelves at all heights.

Figure 4:
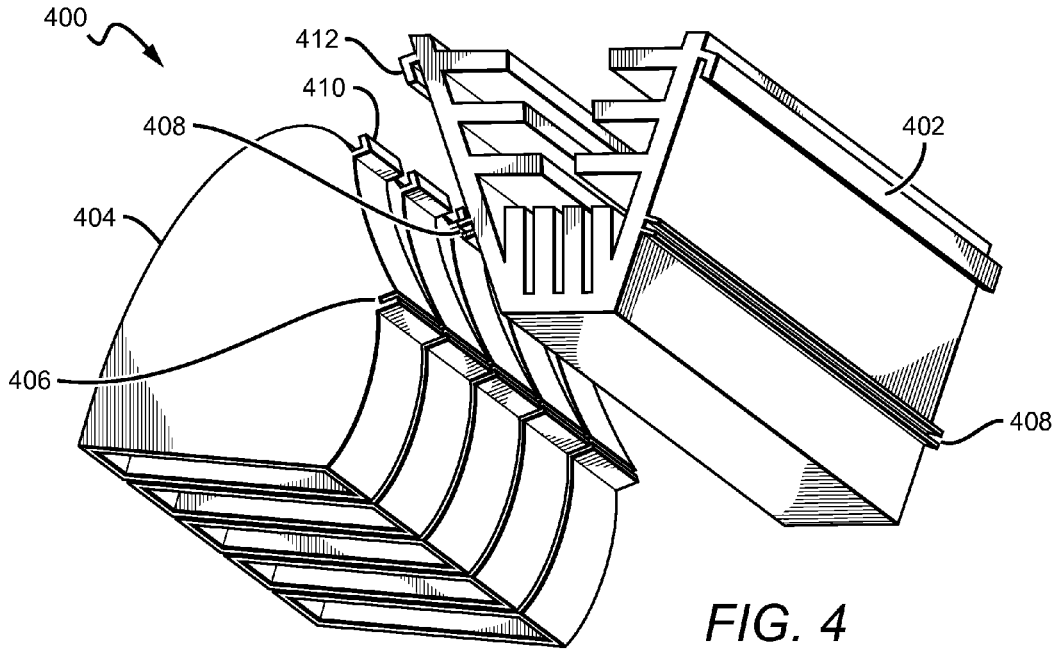
FIG. 4 is a perspective view of a lighting assembly according to an embodiment of the present invention.

FIG. 4 is a perspective view of a lighting assembly 400 according to an embodiment of the present invention. For ease of viewing the light pods 404 are shown disconnected from one side of the elongated heat sink 402. It is understood that when the lighting assembly 400 is assembled for use, the pods 404 are removably connected to the heat sink 402 on one or both sides. This particular embodiment includes five adjacent pods 404. Each pod 404 may be removably mounted to the heat sink 402 using a snap-fit mechanism. In this embodiment, the snap-fit mechanism comprises opposing slots 406, 408. The slots 406 on the pods 404 cooperate with the slots 408 on the heat sink 402 to create a sturdy connection. Opposing guide flanges 410, 412 cooperate to aid in alignment of the opposing slots 406, 408 and to hold the upper portion of the pods against the heat sink 402 when assembled. During assembly of this particular embodiment, the pod flange 410 slides underneath the heat sink flange 412, and the pod 404 swings in to engage the opposing slots 406, 408 for easy mounting and removal. Thus, the pods 404 may be easily replaced or maintained.

It is understood that the pods 404 can be connected to the heat sink 402 in many different ways. For example, the pods 404 may be attached using screws, pins, or the like. Also, the pods 402 may hang from the heat sink using a hook-and-slot attachment mechanism. Other attachment mechanisms are also possible.

Figure 5:
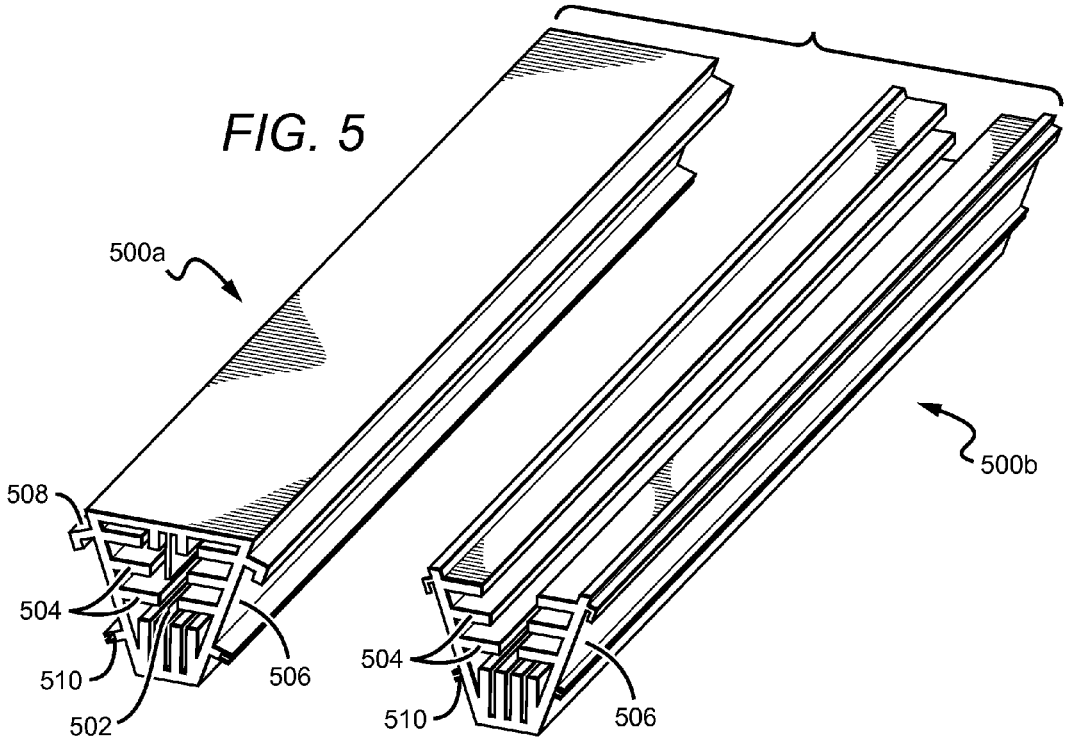
FIG. 5 is a perspective view of two different elongated heat sinks that may be used in embodiments of the present invention.

FIG. 5 shows a perspective view of two different elongated heat sinks 500*a*, 500*b* that may be used in embodiments of the present invention. For ease of fabrication, the heat sinks 500*a*, 500*b* can be extruded from many different thermally conductive materials, such as aluminum, for example.

Although many different mechanical thermal elements can be used in embodiments of the lighting assembly, two exemplary heat sink structures are discussed in detail herein. The heat sinks 500*a*, 500*b* include planar surfaces 506 that provide a mount area for light sources and other electronics. Such elements can be provided on a light strip, for example. Light strips can be mounted to the planar surfaces to provide good thermal communication between the light sources and the heat sink structure. When assembled the planar surfaces 506 align with the cutaway portions of the light pods as discussed herein. Light strips may be attached to the planar surfaces 506 in many ways including, for example, using a thermal adhesive or by mechanical means such as screws.

As noted herein with reference to FIG. 4, in these particular embodiments the heat sinks 500*a*, 500*b* comprise flanges 508 and slots 510 that may be used for mounting the light pods using a snap-fit mechanism. It is understood that the light pods can be mounted to the heat sinks 500*a*, 500*b* in many different ways.

Heat sink 500*a* has a cross-section that is generally shaped like a parallelogram. The heat sink 500*a* is enclosed, with the sides of the heat sink 500*a* defining a throughway 502. Several fins 504 extend from the sides into the throughway 502 to increase surface area and aid in heat dissipation. Heat sink structures are generally known in the art, and it is understood that many different heat dissipation structures, such as fins 504, can be used. In some embodiments, cables or other structures may be disposed within the throughway 502. In other embodiments, the throughway 502 is kept clear to facilitate the flow of air through the heat sink 500*a*. Some embodiments may include a fan at one end of the heat sink 500*a* to move air down the throughway 502, actively cooling the structure. Other active and/or passive cooling elements may also be used. It may be advantageous to use a closed heat sink structure such as that in 500*a* when the lighting assembly is going to be surface mounted to a ceiling because, for example, the top surface of the heat sink 500*a* may be necessary for the surface mount.

Heat sink 500*b* is shaped generally the same as heat sink 500*a* except that heat sink 500*b* comprises three sides such that the structure is left open on the top side. This embodiment allows air to easily escape the heat sink 500*b* into the ambient environment above the lighting assembly. It may be advantageous to use an open air heat sink structure such as that in

500*b* when the lighting assembly is going to be mounted to a ceiling using a suspension type mechanism.

In some embodiments, it may be desirable to connect several smaller heat sink components together to form a longer heat sink. Thus, it is understood that the heat sinks may function as modular components that may be removably connected at the ends using known attachment mechanisms. Such a configuration would be advantageous when transporting and assembling/disassembling the lighting assemblies, for example.

As noted, the pods may be attached to several different kinds of central mechanical thermal elements. For example, in some embodiments the mechanical thermal element can be configured into a geometric shape, such as a circle, a square, or an octagon, for example. Indeed, it is understood that the mechanical thermal element can be shaped to accommodate many different pod arrangements and light output profiles.

Figure 6D:
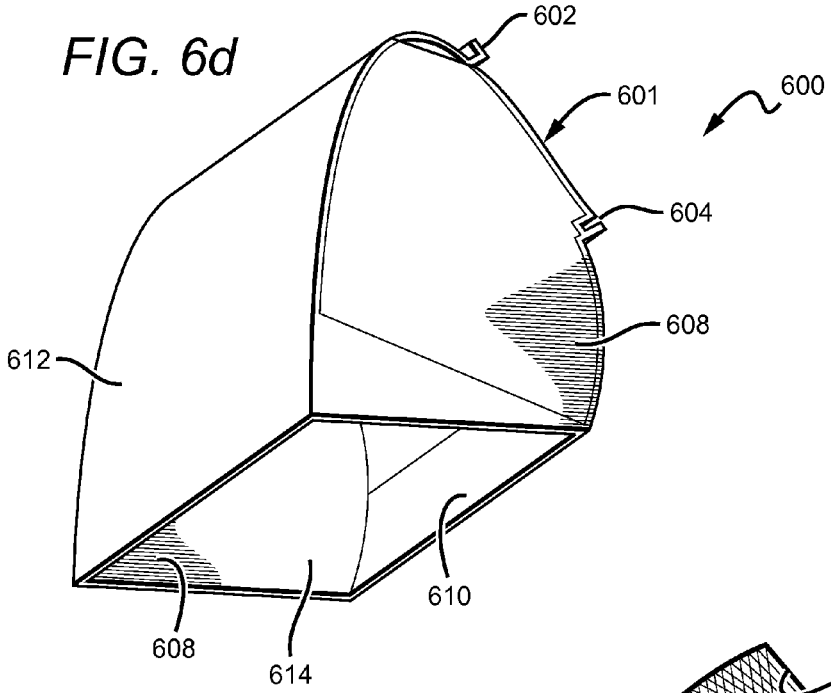

FIGS. 6*a-d* show a light pod 600 that may be used in lighting assemblies according to embodiments of the present invention. FIG. 6*a* is a perspective view of the light pod 600. The light pod 600 may be made from many materials, including light weight metals (e.g., aluminum) or plastics, for example. In this embodiment, the light pod 600 has four sides with an open end at the bottom (not shown in this view) to allow light to escape. The four sides comprise reflective interior surfaces that define an interior cavity wherein the light may be directed into a desired output beam. The contour of the interior surfaces is discussed in more detail herein. The mount side of the pod 600 comprises structures for mounting to the heat sink. In this embodiment, the pod 600 comprises a base 601 which includes a flange 602 and a slot 604 for a snap-fit mount. The mount side of the pod 600 has a portion cutaway 606 such that light sources mounted to the heat sink can be adjacent to or protrude through the pod 600 into the interior cavity when the components are assembled. In this embodiment, the side panel 608 is shown; a mirror image side panel is disposed opposite the side panel 608. The interior contour of the side panel 608 is discussed in more detail herein.

FIG. 6*b* is a side profile view of the light pod 600. The light pod 600 may be shaped in several different ways for an interior contour that results in a particular output beam profile. In this embodiment, the pod comprises four panels: the mount side panels 608, the mount side panel 610, and the front panel 612. As shown in FIG. 6*b*, the mount side panel 610 and the front panel 612 have a curved profile that is nearly parabolic. When assembled, light sources are positioned adjacent to or through the cutaway portion of the pod 600 such that light from the sources is emitted into the interior cavity where a portion of it will interact with the interior surfaces of the pod (as shown in FIGS. 7*a*, 7*b*, 8*a*, and 8*b*). In this embodiment, the front panel 612 extends down farther from the base 601 than the mount side panel 610. This structure prevents light from being directly emitted at too high an angle to contribute to the desired aisle light profile.

FIG. 6*c* is a front side perspective view of the pod 600. The mount flange 602 is visible over the top portion of the front panel 612. The side panels 608 are mirror images of one another and have a parabolic profile in this embodiment. The side panels 608 are designed to prevent too much of the output light from spilling out in the longitudinal direction. Light that impinges the side panels 608 is generally directed in a downward direction through the opening. Thus, the output beam from each pod 600 is shaped such that it is confined in the longitudinal direction.

FIG. 6*d* is a perspective view of the pod 600 from an angle below it. As shown, the front panel 612, the mount side panel 610, and the two opposing side panels 608 define an interior cavity 614. In this embodiment, the bottom end of the pod 600 is left open to allow light to escape. Other embodiments may include a lens or another transmissive cover to close the end of the pod 600.

The light pod 600 and a corresponding heat sink can come in several different sizes depending on the particular application. In one embodiment, the pod 600 measures roughly 7.5 inches from the base 601 to the open end at the farthest point and 6.5 inches wide from the front panel 612 to the mount side panel 610 at the farthest point. These dimensions would correspond to a heat sink that is roughly 5 inches tall along one of the side surfaces. It is understood that the given dimensions are merely exemplary; many different sizes and size combinations are possible.

Figure 7A:
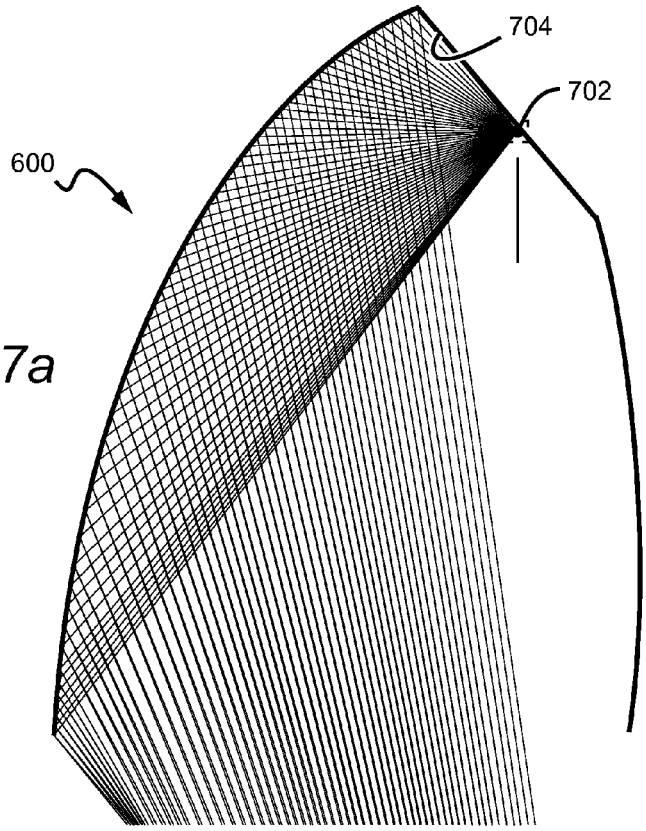
FIGS. 7*a* and 7*b* show a cross-sectional profile view of the interior surfaces of a light pod according to an embodiment of the present invention wherein the paths of several light rays are modeled.
Figure 7B:
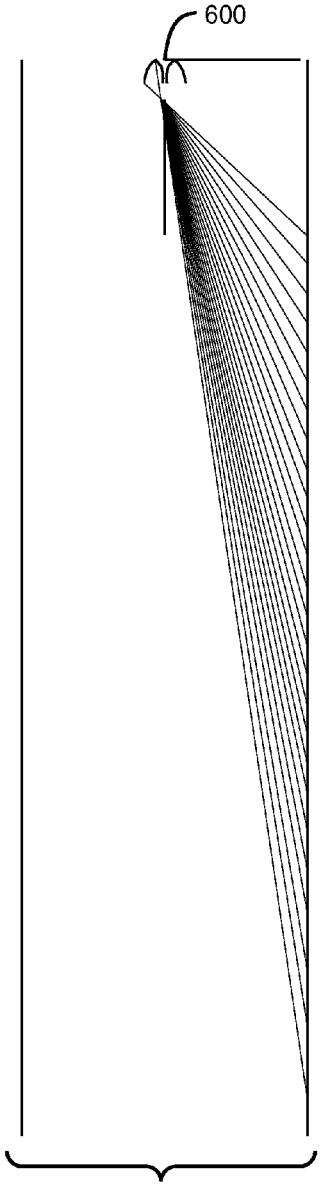

FIGS. 7*a* and 7*b* show a cross-sectional profile view of the interior surfaces of the pod 600 wherein the paths of several light rays are modeled. A light source 702 is disposed at the cutaway portion of the base. Although the source 702 is a 2 pi emitter (i.e., it initially emits in a hemispherical pattern), for ease of viewing only those rays that impinge the front panel interior surface 704 are shown in this figure. This embodiment comprises specular reflective interior surfaces (e.g., a silver coated surface). The surface 704 is nearly parabolic. Some embodiments may comprise parabolic interior surfaces; others may comprise curved, linear, or piecewise interior surfaces. Many different interior surface shapes are possible. The impinging rays are redirected by the interior surface 704 away from the base and toward the open end. As shown in FIG. 7*b*, the light is redirected in a direction such that it hits an area over a large height, for example, over a tall shelf.

Figure 8A:
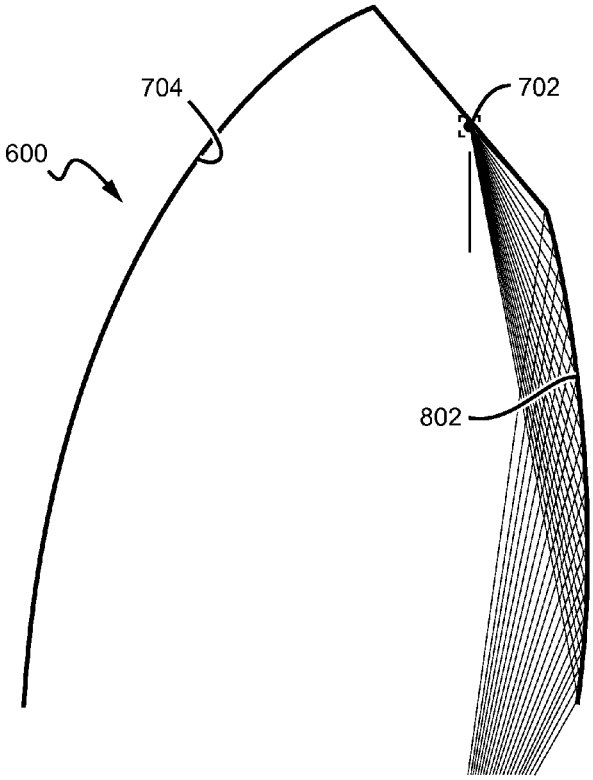
FIGS. 8*a* and 8*b* show a cross-sectional profile view of the interior surfaces of a light pod according to an embodiment of the present invention wherein the paths of several light rays are modeled.
Figure 8B:
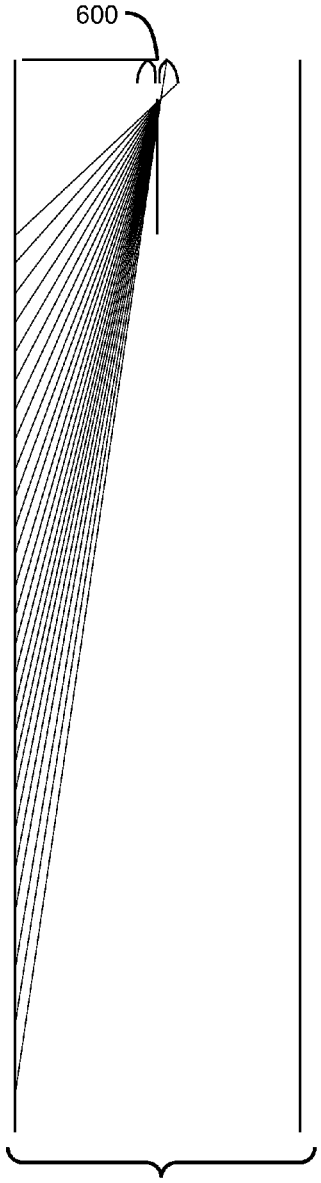

FIGS. 8*a* and 8*b* show a cross-sectional profile view of the interior surfaces of the pod 600 wherein the paths of several light rays are modeled. Although the source 702 is a 2 pi emitter, for ease of viewing only those rays that impinge the mount side interior surface 802 are shown in this figure. Light that impinges specular interior surface 802 is redirected in a downward direction away from the base and toward the open end of the pod 600. The interior surface 802 is parabolic in this embodiment. However, it is understood that the surface can be curved, straight, or piecewise.

With reference to configuration shown in FIG. 1 and as shown in FIG. 7*b*, the interior surface 704 is shaped to redirect light back out of the open end of the pod 600 in a direction that illuminates a shelf on the opposite side of the aisle from the pod 600. Thus, in the embodiment featuring pod 600, each pod contributes to the illumination of shelves on both sides of the pod.

The interior surfaces of the pods may comprise specular or diffuse reflective materials. One acceptable material for the interior reflective surfaces is a silver coating. In this case the interior surfaces would be specular reflective. Many other materials will also suffice to produce a specular reflective surface. Another acceptable option is a diffuse white reflective material such as a microcellular polyethylene terephthalate (MCPET) material or a DuPont/WhiteOptics material, for example. Other white diffuse reflective materials can also be used. Diffuse reflective surfaces have the inherent capability to mix light from solid state light sources having different spectra (i.e., different colors). These coatings are particularly well-suited for multi-source designs where two different spectra are mixed to produce a desired output color point. For example, LEDs emitting red light may be used in combination with LEDs emitting yellow (or blue-shifted yellow) light to yield a white light output. A diffuse reflective surface may eliminate the need for additional spatial color-mixing schemes that can introduce lossy elements into the system; although, in some embodiments it may be desirable to use a diffuse surface in combination with other diffusive elements.

Figure 9A:
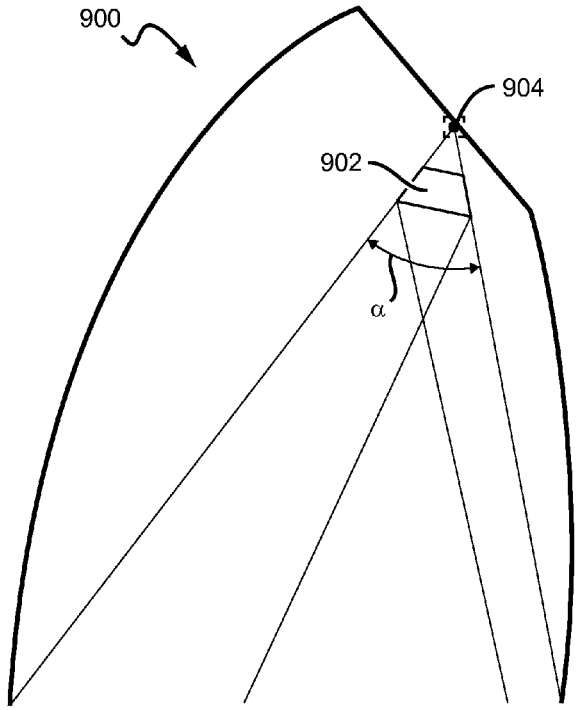

In some cases, it may be desirable to collimate the light emitted from each of the pods to a greater degree. FIGS. 9*a* and 9*b* are cross-sectional views of the interior surfaces of a pod 900 wherein the paths of several light rays are modeled. The pod 900 is similar to the pod 600, except that pod 900 comprises an internal lens 902 mounted within the interior cavity of the pod 900. The lens 902 can be mounted in the cavity with a post (not shown) extending from one of the interior surfaces, for example. In this particular embodiment, the lens 902 is positioned to interact with the light emitted from the source 904 that would have escaped directly from the pod 900 (i.e., without impinging on any of the interior surfaces). Light emitted from the source 904 within an angle $\alpha$ passes through the lens 902 which collimates the light; light emitted from the source 904 outside of angle $\alpha$ will impinge on one of the interior surfaces of the pod 900. Thus, light that would have escaped the pod 900 directly if not for the lens 902 is emitted in a tighter beam. The lens 902 has the effect of focusing more of the emitted light in a downward direction. In other embodiments, lenses having many different properties can be positioned within the cavity to achieve a particular output beam profile.

Although exemplary embodiments of the lighting assembly herein have been shown as linear arrays with pods on both sides of an elongated heat sink, it is understood that the removable pods can be arranged in different ways around an attachment structure. For example, the elongated heat sink may be a circular structure with pods mounted around the perimeter. Many other arrangements are possible.

Figure 10A:
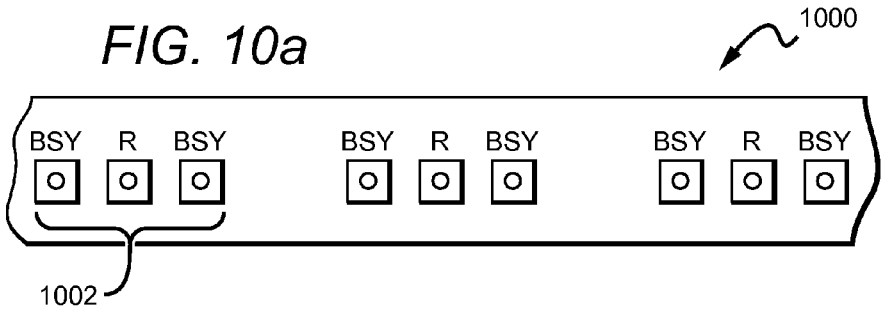
FIGS. 10*a-c* show a top view of portions of several light strips that may be used in embodiments of the lighting assembly according to embodiments of the present invention.
Figure 10B:
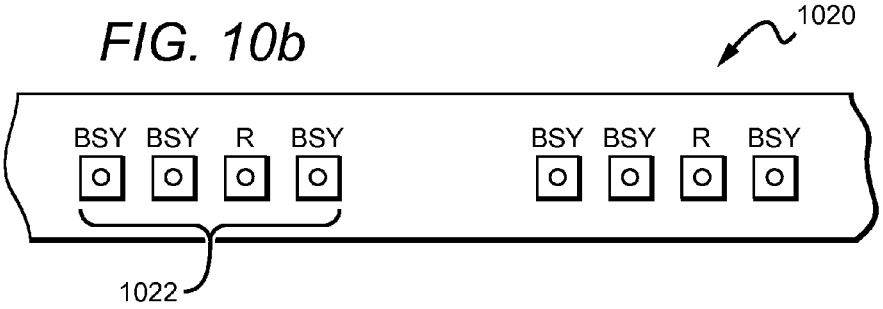
Figure 10C:
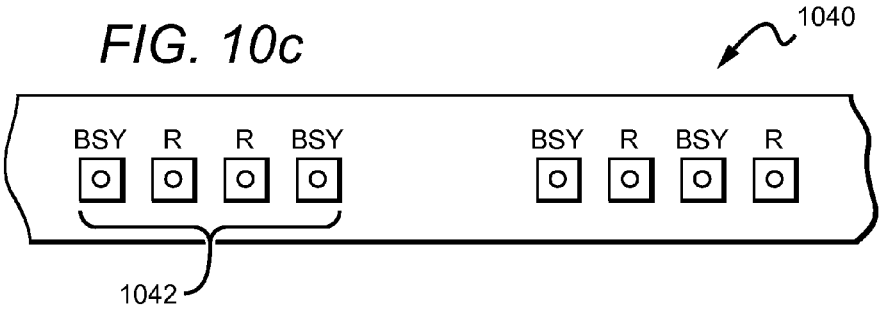

With reference to FIG. 5, the mount surface 506 provides a substantially flat area on which one or more light sources can be mounted. In some embodiments, the light source(s) will be pre-mounted on light strips, such as a printed circuit board (PCB). FIGS. 10*a-c* show a top view of portions of several light strips 1000, 1020, 1040 that may be used to mount multiple LEDs to the mount surface 506. Although LEDs are used as the light sources in various embodiments described herein, it is understood that other light sources, such as laser diodes for example, may be substituted in as the light sources in other embodiments of the invention.

Many industrial, commercial, and residential applications call for white light sources. Embodiments of the lighting assembly disclosed herein may comprise one or more emitters producing the same color of light or different colors of light. In one embodiment, a multicolor source is used to produce white light. Several colored light combinations will yield white light. For example, as discussed in U.S. Pat. Nos. 7,213,940 and 7,768,192, both of which are assigned to Cree, Inc., and both of which are incorporated herein by reference, it is known in the art to combine light from a blue LED with wavelength-converted yellow light to yield white light with correlated color temperature (CCT) in the range between 5000K to 7000K (often designated as "cool white"). Both blue and yellow light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The yellow light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several color combinations are described in detail in patents to Van de Ven (U.S. Pat. Nos. 7,213,940 and 7,768,192; both also owned by Cree, Inc.) which are incorporated by reference herein.

The light strips 1000, 1020, 1040 each represent possible LED combinations that result in an output spectrum that can be mixed to generate white light. Each lighting strip can include the electronics and interconnections necessary to power the LEDs. In some embodiments the light strip comprises a PCB with the LEDs mounted and interconnected thereon. The light strip 1000 includes clusters 1002 of discrete LEDs, with each LED within the cluster 1002 spaced a distance from the next LED, and each cluster 1002 spaced a distance from the next cluster. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 10*a* uses a series of clusters 1002 having two blue-shifted-yellow LEDs ("BSY") and a single red LED ("R"). BSY refers to a color created when blue LED light is wavelength-converted by a yellow phosphor. The resulting output is a yellow-green color that lies off the black body curve. BSY and red light, when properly mixed, combine to yield light having a "warm white" appearance.

The lighting strip 1020 includes clusters 1022 of discrete LEDs. The scheme shown in FIG. 10*b* uses a series of clusters 1022 having three BSY LEDs and a single red LED. This scheme will also yield a warm white output when sufficiently mixed.

The lighting strip 1040 includes clusters 1042 of discrete LEDs. The scheme shown in FIG. 10*c* uses a series of clusters 1042 having two BSY LEDs and two red LEDs. This scheme will also yield a warm white output when sufficiently mixed.

The lighting schemes shown in FIGS. 10*a-c* are meant to be exemplary. Thus, it is understood that many different LED combinations can be used in concert with known conversion techniques to generate a desired output light color.

FIG. 11 is a perspective view of a heat sink 1100 that may be used in lighting assemblies according to embodiments of the present invention. The heat sink 1100 features a fan 1102 that facilitates the flow of air through the heat sink and actively cools the device. Other active cooling devices may also be used to improve thermal dissipation.

Figure 12:
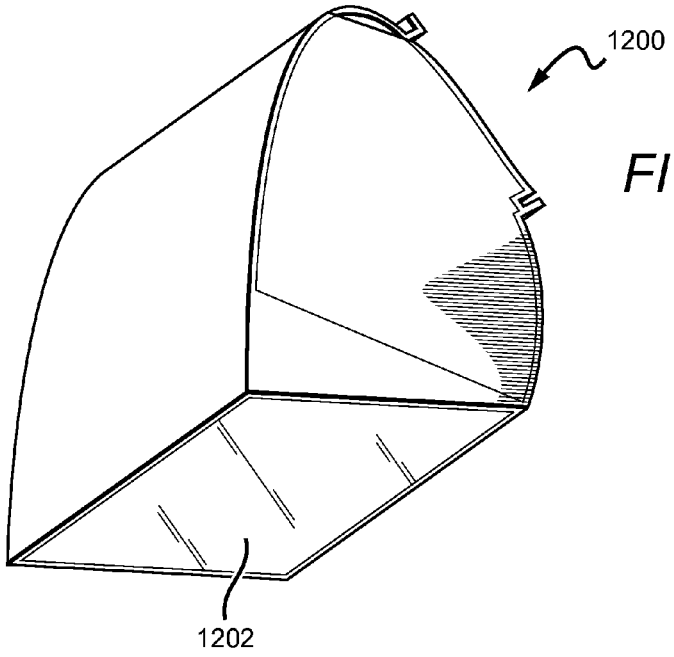
FIG. 12 is a perspective view of a light pod according to an embodiment of the present invention.

FIG. 12 is a perspective view of a light pod 1200 from an angle below it. The light pod 1200 is similar to the light pod 600; however, this particular embodiment includes a transmissive lens 1202 that covers the end of the pod 1200. The lens 1202 can be used for many different purposes, including color mixing, beam shaping, and polarization, for example. Additionally, the lens 1202 may protect internal elements and light sources from the outside environment.

Figure 13:
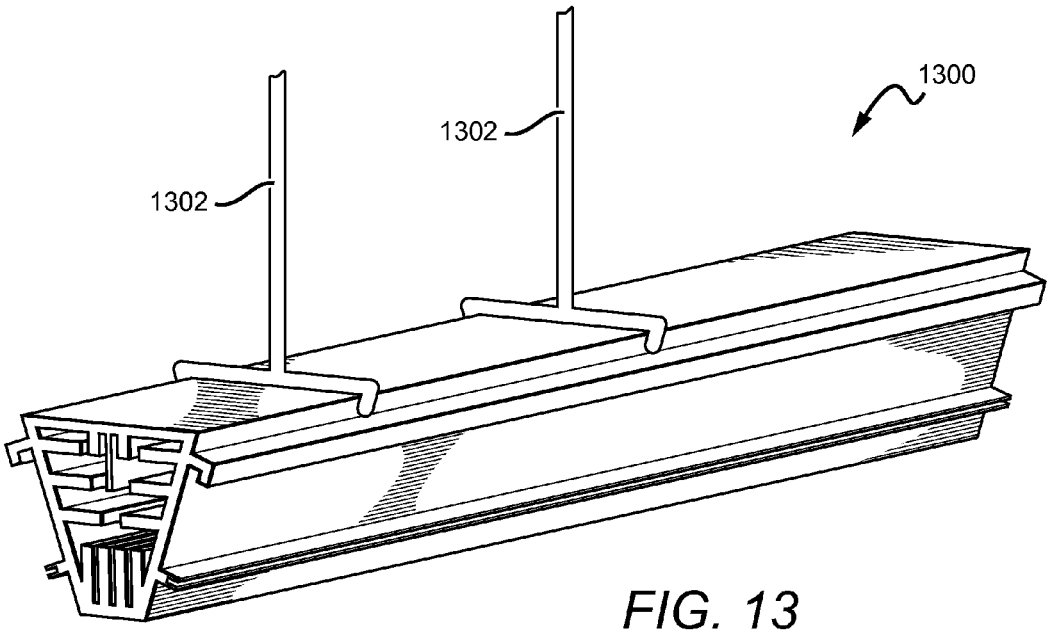
FIG. 13 is a perspective view of a heat sink that may be used in lighting assemblies according to embodiments of the present invention.

FIG. 13 is a perspective view of a heat sink 1300 that may be used in lighting assemblies according to embodiments of the present invention. In this embodiment, the heat sink 1300 is mounted to a ceiling using suspension mounts 1302. It is understood that many different suspension mount mechanisms may be used to achieve a similar arrangement.

It is understood that embodiments presented herein are meant to be exemplary. Embodiments of the present invention can comprise any combination of compatible features shown in the various figures, and these embodiments should not be limited to those combinations expressly illustrated and discussed. Although the present invention has been described in detail with reference to certain configurations thereof, other versions are possible. Therefore, the spirit and scope of the invention should not be limited to the versions described above.

We claim:

1. A light fixture assembly, comprising:

an elongated heat sink; and at least one light pod removably mounted to at least one surface of said heat sink, at least one of said light pod comprising a hollow body, said hollow body defining an interior cavity and an open end.

2. The light fixture assembly of claim 1, said light fixture assembly further comprising a plurality of light pods removably mounted along a longitudinal direction of said heat sink.

3. The light fixture assembly of claim 1, wherein each pod comprises a mount structure for removably mounting said pods to said at least one surface of said heat sink.

4. The light fixture assembly of claim 1, wherein said body comprises an interior reflective surface.

5. The light fixture assembly of claim 4, said interior reflective surface comprising a specular finish.

6. The light fixture assembly of claim 1, said body defining a cutaway portion shaped to receive a linear light strip.

7. The light fixture assembly of claim 6, wherein said heat sink comprises at least one surface whereupon a light strip can be mounted, said at least one surface disposed to align with said cutaway portion when said pod is mounted to said heat sink.

8. The light fixture assembly of claim 1, wherein each of said pods is removably mounted to said heat sink with a snap-fit structure.

9. The light fixture assembly of claim 1, each of said pods further comprising a lens over said open end of said body.

10. The light fixture assembly of claim 1, each of said pods further comprising a lens mounted within said cavity.

11. The light fixture assembly of claim 1, further comprising a ceiling mount mechanism for mounting said heat sink to a ceiling.

12. The light fixture assembly of claim 11, wherein said ceiling mount mechanism comprises a suspension structure.

13. The light fixture assembly of claim 1, wherein said heat sink is open along one longitudinal surface.

14. The light fixture assembly of claim 1, wherein said heat sink defines an enclosed throughway.

15. The light fixture assembly of claim 14, further comprising a fan mounted to one end of said heat sink.

16. A lighting assembly, comprising:

an elongated heat sink;

at least one light strip comprising at least one light source, said at least one light strip mounted to a surface of said heat sink; and at least one light pod removably mounted to said heat sink, each of said light pods comprising a body that defines a cutaway portion, an interior cavity, and an open end;

wherein said at least one light pod is mounted to said heat sink such that said light strip is aligned with said cutaway portion of said light pod.

17. The lighting assembly of claim 16, said heat sink comprising two planar surfaces and mount structures running along the length of said heat sink such that a plurality of said light pods can be mounted on both lateral sides of said heat sink.

18. The lighting assembly of claim 16, said heat sink comprising a substantially trapezoidal cross-section.

19. The lighting assembly of claim 16, wherein said heat sink is open along one longitudinal surface.

20. The lighting assembly of claim 16, wherein said heat sink defines an enclosed throughway.

21. The lighting assembly of claim 16, further comprising a fan mounted to one end of said heat sink.

22. The lighting assembly of claim 16, said heat sink comprising extruded metal.

23. The lighting assembly of claim 16, said heat sink comprising a snap-fit mount structure.

24. The lighting assembly of claim 16, said at least one light strip comprising a plurality of light emitting diodes (LEDs).

25. The lighting assembly of claim 24, wherein said LEDs are arranged in clusters on said at least one light strip.

26. The lighting assembly of claim 16, wherein said body comprises an interior reflective surface.

27. The lighting assembly of claim 26, said interior reflective surface comprising a specular finish.

28. The lighting assembly of claim 16, wherein each pod comprises a mount structure for removably mounting said pods to said heat sink.

29. The lighting assembly of claim 16, wherein each of said pods is removably mounted to said heat sink with a snap-fit structure.

30. The lighting assembly of claim 16, each of said pods further comprising a lens over said open end of said body.

31. The lighting assembly of claim 16, each of said pods further comprising a lens mounted within said cavity.

32. The lighting assembly of claim 16, further comprising a ceiling mount mechanism for mounting said heat sink to a ceiling.

33. The lighting assembly of claim 32, wherein said ceiling mount mechanism comprises a suspension structure.

34. A light fixture assembly, comprising:

a mechanical thermal element; and at least one light pod removably mounted to at least one surface of said mechanical thermal element, each of said light pods comprising a hollow body, said hollow body defining an interior cavity and an open end.

35. The light fixture assembly of claim 34, wherein said mechanical thermal element is configured as a geometric shape.

36. The light fixture assembly of claim 34, wherein each pod comprises a mount structure for removably mounting said pods to said at least one surface of said mechanical thermal element.

* * * * *